United States Patent [19]

Tsubo

[11] Patent Number: 4,556,209

[45] Date of Patent: Dec. 3, 1985

[54] SHEET FEEDING APPARATUS

[75] Inventor: Shuzo Tsubo, Kawasaki, Japan

[73] Assignee: Tokyo Shibaura Denki Kabushiki Kaisha, Kawasaki, Japan

[21] Appl. No.: 556,782

[22] Filed: Dec. 1, 1983

[30] Foreign Application Priority Data

Dec. 1, 1982 [JP] Japan ..... 57-210898
Apr. 30, 1983 [JP] Japan ..... 58-76659

[51] Int. Cl.[4] ..... B65H 3/52

[52] U.S. Cl. ..... 271/10; 271/118; 271/122

[58] Field of Search ..... 271/10, 118, 122, 125

[56] References Cited

U.S. PATENT DOCUMENTS 2,363,357 11/1944 Post ..... 271/118
3,108,801 10/1963 Van Dalen ..... 271/12
3,961,786 6/1976 Yanker ..... 271/12

*Primary Examiner*—Richard A. Schacher
*Attorney, Agent, or Firm*—Cushman, Darby & Cushman

[57] ABSTRACT

A sheet feeding apparatus including feeding rollers arranged above a sheet table on which sheets are stacked, and contactable with the top of the sheets, and a pressing member arranged below the sheet table to project above through the sheet table and intermittently press the sheets on the sheet table to contact the top of the stacked sheets with the feeding rollers. The top sheet of the stack can be reliably fed by the pressing member and the feeding rollers to conveying rollers and then conveyed by the conveying rollers. The sheets stacked on the sheet table can be reliably fed one by one from the top of the stacked sheets.

15 Claims, 30 Drawing Figures

SHEET FEEDING APPARATUS

BACKGROUND OF THE INVENTION

The present invention relates to an apparatus for successively feeding a sheet from the top of stacks of sheets.

Apparatus which store a lot of filmy sheets made of, e.g., paper metal or plastic and separately feed the stored sheets one by one are generally known. For copying machines, for example, a sheet feeding apparatus is provided to automatically feed original documents stacked on the tray toward the light exposing table so as to automatically copy the original documents one by one. The sheet feeding apparatus includes an oblique sheet table on which documents are stacked, a guide plate for guiding the documents stacked on the sheet table in such a way that the foremost edges of the documents are successively shifted from the top of the stacked documents, and a pair of rotary feeding rollers (or means) which contact the document nearest the rollers or on top of the stacked documents. The pair of feeding rollers feed the documents one by one in such an order that the documents are pulled in between the rollers. When a lot of documents are stacked on the table, however, the foremost edges of the stacked documents located adjacent to the feeding rollers may not be correctly shifted from the top of the stacked documents successively. If so, the document on the top of the stack is brought into contact with one feeding roller at a position where the top document is farther from the contact portions of the paried feeding rollers than some of the successively following document, so that not the top document but a second or third sheet may be pulled in between the contact portions of the paired feeding rollers prior to the top document. Namely, the conventional sheet feeding apparatus has the drawback that the stacked documents could not be successively fed from the top thereof.

In addition when a lot of documents are stacked on the document table, there is the disadvantage that an document other than the top one, and nearest to the feeding rollers may be pulled in between the feeding rollers prior to the top document, when the foremost edge of the top document is curled or when the foremost edges of the documents are not correctly shifted from the top of the stacked documents successively because of the friction between the documents. Accordingly, conventional sheet feeding apparatus are not reliable in successively feeding documents.

SUMMARY OF THE INVENTION

The object of the present invention is to provide a sheet feeding apparatus capable of reliably and successively feeding sheets one by one from the top of a stack.

According to one aspect of the present invention, there is provided a sheet feeding apparatus for successively feeding sheets one by one from the top of a stack, the apparatus comprising a sheet table on which the sheets are stacked; feeding means capable of contacting a sheet laid on the top of the stack on the sheet table and, upon contact with the top sheet, picking up and feeding it from the sheet table; pressing means for causing the sheet on the top of stack on the sheet table to intermittently contact the feeding means; and a conveying means for conveying the sheets one by one when they are brought into contact therewith after having been fed by the feeding means.

DETAILED DESCRIPTION OF THE PREFERRED EMBODIMENT

An embodiment of the present invention will be described in detail with reference to the accompanying drawings.

Figure 1:
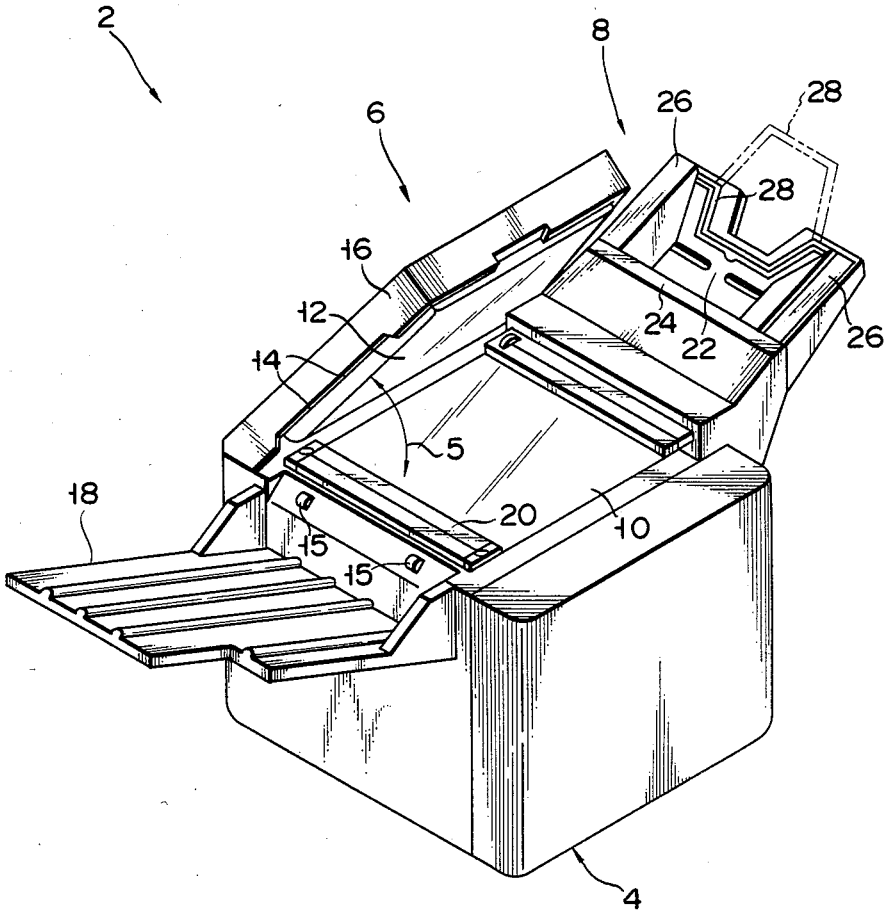
FIG. 1 is a perspective view showing a copying machine provided with an example of an automatic document feeding apparatus according to the present invention.

As shown in FIG. 1, a document or sheet feeding apparatus 8 is provided at the upper portion of body 4 of electronic copying machine 2, documents which are to be copied are laid thereon and successively fed one by one from the top toward a conveyor 6, which will be described later. Also provided at the upper portion of the copying machine body 4 is an exposing table 10 which serves to expose the documents to be copied and which is made of transparent material. Arranged on the exposing table 10 is the coveyor 6 which swings in the directions shown by arrow 5 and which is closed onto the exposing table 10 by the operator when exposure is performed.

The coveyor 6 includes a belt 12 for conveying the documents fed from the document feeding apparatus 8, a discharging roller 14 which co-operates with a roller 15 arranged on the machine body 4 near the exposing table 10 to discharge the documents, and a cover 16. Attached to that side of the exposing table 10 which is opposite to the document feeding apparatus is a tray 18 for receiving the documents conveyed by the conveyor 6 after they have been exposed. Also arranged on the exposing table 10 is a document stopping member 20 for contacting the foremost edge of a document conveyed by the conveying belt 12 and stopping the document to set it at a predetermined exposing position on the exposing table 10. The document stopping member 20 rotates in the direction shown by arrow 21 in FIG. 2.

Attached to the document feeding apparatus 8 is a document table 22 oblique relative to the light exposing table 10 and on which a plurality of documents are stacked. A chamber 24 for housing the foremost edge portions of the documents is arranged on the document-fed side of the document table 22 when viewed from the document conveying direction. Guide plates 26, which can be slid perpendicular to the document conveying direction, are arranged on both sides of the document table 22 and in the document conveying direction are for guiding the documents. An auxiliary document table member 28 is rotatably supported by the document table 22 on that side of the document table 22 which is opposite to the chamber 24 forming an extension for the document table 22 according to the size of the documents. More specificaly, the auxiliary document table member 28 is arranged on the document table 22 in such a way that the former can rotate by about 150° relative to the latter.

Mechanisms of the conveyor 6 and the document feeding apparatus 8 will be described with reference to FIG. 2.

The conveyor 6 includes belt rollers 30 and 32 for driving the conveying belt 12, and the conveying belt 12 is stretched between the belt rollers 30 and 32. Arranged inside the conveying belt 12 are pressing rollers 34 for pressing a document fed between the conveying belt 12 and the exposing table 12 onto the exposing table 10.

Figure 2:
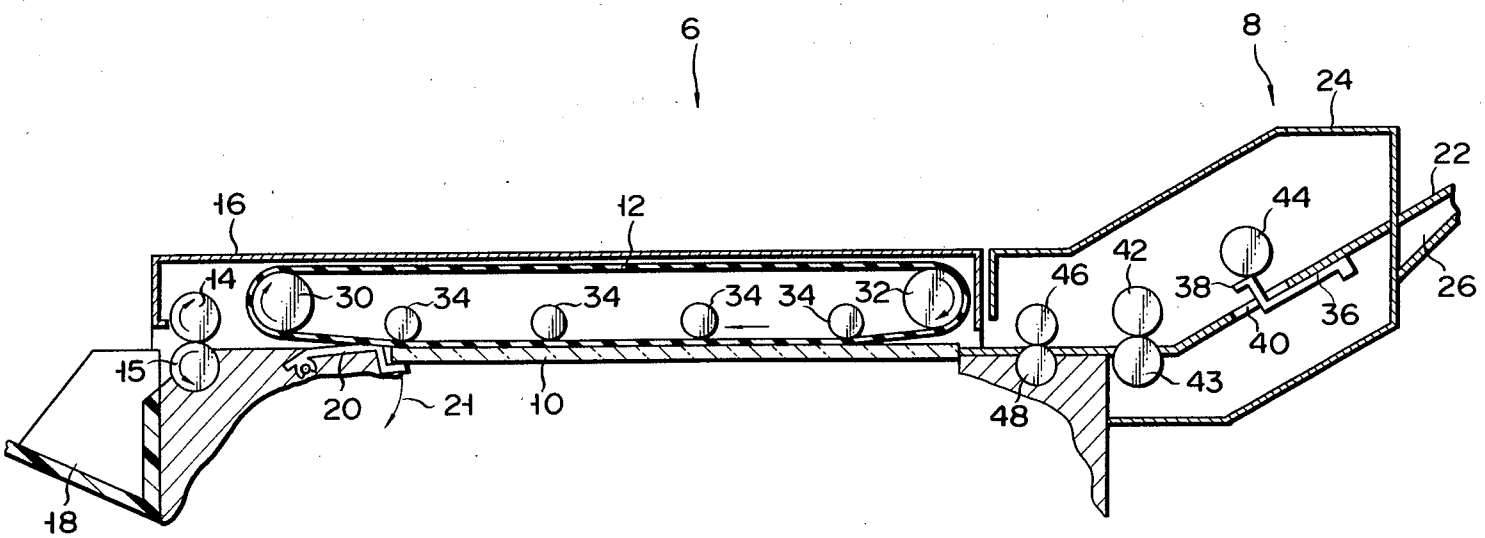
FIG. 2 is a sectional view showing the automatic document feeding apparatus of FIG. 1 and a coveying belt means.
Figure 3:
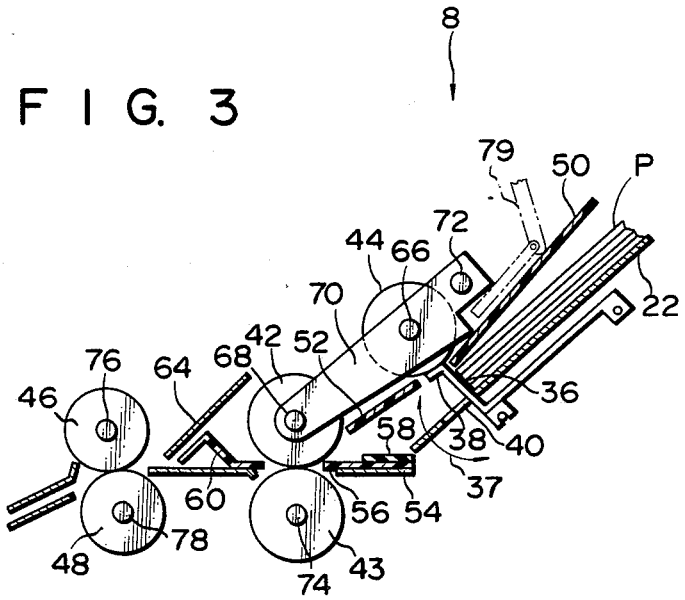
FIG. 3 is a side view showing the mechanism of the automatic document feeding apparatus shown in FIG. 1.

As shown in FIGS. 2 and 3, the document feeding apparatus 8 includes a stopper (or pressing means) 36 which swings in the directions shown by an arrow 37 in FIG. 3, so as to temporarily stop the stacked documents moving from the document table 22, to make the foremost edges of the stacked documents even, and to intermittently press the documents three times per second, from below after the documet have been dropped along the oblique surface of the document table 22. The stopper 36 has a reversed-L shape and its one end is swingably supported by the chamber 24. The other end of the stopper 36 is provided, at its right-angled portion, with a striker 38 by which the documents can be pressed upward toward the document table 22. The striker 38 is made of a material such as urethane rubber, for example, having a large friction coefficient. The document table 22 is provided with a hole through which the striker 38 of the stopper 36 projects.

The chamber 24 includes feeding rollers 44 arranged above the striker 38 to feed a document laid on the top of the stack toward a pair of separating rollers 42 and 43, which will be described later. These feeding rollers 44, whose operation will be later described in detail, are brought into contact with a document laid on the top of the stack when the stack is intermittently lifted or pressed toward the feeding rollers by the striker 38, so that only the top document is intermittently and positively fed to the contact portions of the paired separating rollers 42 and 43. Therefore, only the top document can be fed to the paired separating rollers 42 and 43.

When a plurality of documents including the top one are fed, the paired separating rollers 42 and 43 are rotated to separate the documents one by one and only the top document is fed to the conveyor 6 on the exposing table 10. A pair of resist rollers 46 and 48 are arranged between the exposing table 10 and the separating rollers 42, 43. These resist rollers 46 and 48 whose mechanism will be later described in detail serve to control the timing at which the documents are fed to the conveyor 6.

According to the arrangement as roughly described above, the document feeding apparatus 8 enables the documents stacked on the document table 22 to be reliably fed one by one from the top of the stacked documents toward the exposing table 10. The document which has reached the exposing table 10 is set at a predetermined position on the exposing table 10 by means of the conveyor 6 and then exposed. After exposure, the document is further fed by the conveyor 6 (which includes the discharging rollers 14 and 15) to the tray 18. The same process is repeated for copying a plurality of documents.

The documents feeding apparatus 8 will be described in more detail with reference to FIGS. 3 and 4.

Arranged above the document table 22 are first and second guide members 50 and 52 for smoothly and reliably guiding the documents P when the documents P, which are stopped halfway to the document table 22 by the stopper 36, are slid down onto the document table 22. The first and second guide members 50 and 52 are made of a plastic material, Mylar Sheet TM, for example, having low friction. The documents are stopped halfway to the oblique document table 22 by the stopper 36 and then slid down onto the document table 22 by releasing the stopper 36. Wrinkled documents P may cause the component members of the document feeding apparatus, such as the feeding rollers 44, to jam. However, this jamming problem can be solved by the first and second guide members.

Figure 4:
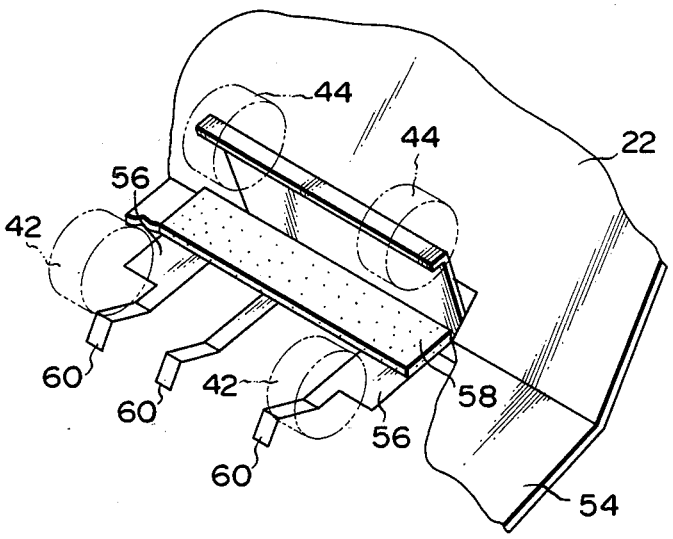
FIG. 4 is a perspective view showing a part of the mechanism of the automatic document feeding apparatus shown in FIG. 3.

As shown in FIG. 4, the lower end portion of the oblique document table 22 is bent to form a guide plate 54 for guiding the foremost edges of the documents sliding down on the document table 22. Third guide members 56 are attached to the guide plate 54 for guiding the leading edges of the documents to the separating rollers 42 and 43. The third guide members 56 are made of a plastic material, such as Mylar Sheet TM, having a low friction coefficient, and extending adjacent to the separating roller.

Attached onto the third guide members 56 near the bent portion of the document table 22 which forms the guide plate 54 is a friction control member 58, which may be a sheet of urethane rubber, for example, for striking against the leading edges of the documents, which slide down in stacked state, so as to control the movement of the document by friction.

Fourth guide members 60 made of plastic a material such as Mylar Sheet TM, having a low friction coefficient and which serve to smoothly move the documents, are arranged between the separating rollers 42 and the resist rollers 46 along the guide plate 54. Each of the fourth guide members 60 is formed to have a reversed-V projection. The bending direction of the document located between the resist rollers 46 and the separating rollers 42 is controlled by these projections of the fourth guide members 60. The foremost ends 62 of the fourth guide members 60 are left free, so that the fourth guide members 60 can be made flat when pressed from above. In this embodiment, the third and fourth guide members 56 and 60 are made of a sheet of Mylar and are integral to each other.

An upper guide 64 for controlling the bending of the document or guiding the document between the separating rollers 42 and the resist rollers 46 is arranged above the fourth guide members 60.

The feeding rollers 44 and the upper separating rollers 42 are connected integral to a pair of first arms 70 through a feeding roller shaft 66 and an upper separating roller shaft 68, respectively. The first arms 70 are rotatably supported by an arm shaft 72.

The lower separating rollers 43 and the upper and lower resist rollers 46, 48 are supported by shafts 74, 76 and 78, respectively.

A document detecting mechanism 79 for detecting whether or not the documents are stacked on the document table 22, and which will be later described in detail, is arranged above the document table 22, as shown by a two-dot-dash line in FIG. 3.

Driving mechanisms of the document feeding apparatus 8 and the conveyor 6 will be described with reference to FIG. 5.

These driving mechanisms are provided with a first power transmitting system 82 having a reversible motor 80, for example, which serves as a driving source common to a stopper driver for driving the stopper 36, a feeding roller driver for driving the feeding rollers 44, a separating roller driver for driving the saparating rollers 42 and 43, a resist roller driver, and a conveying roller driver.

Figure 6:
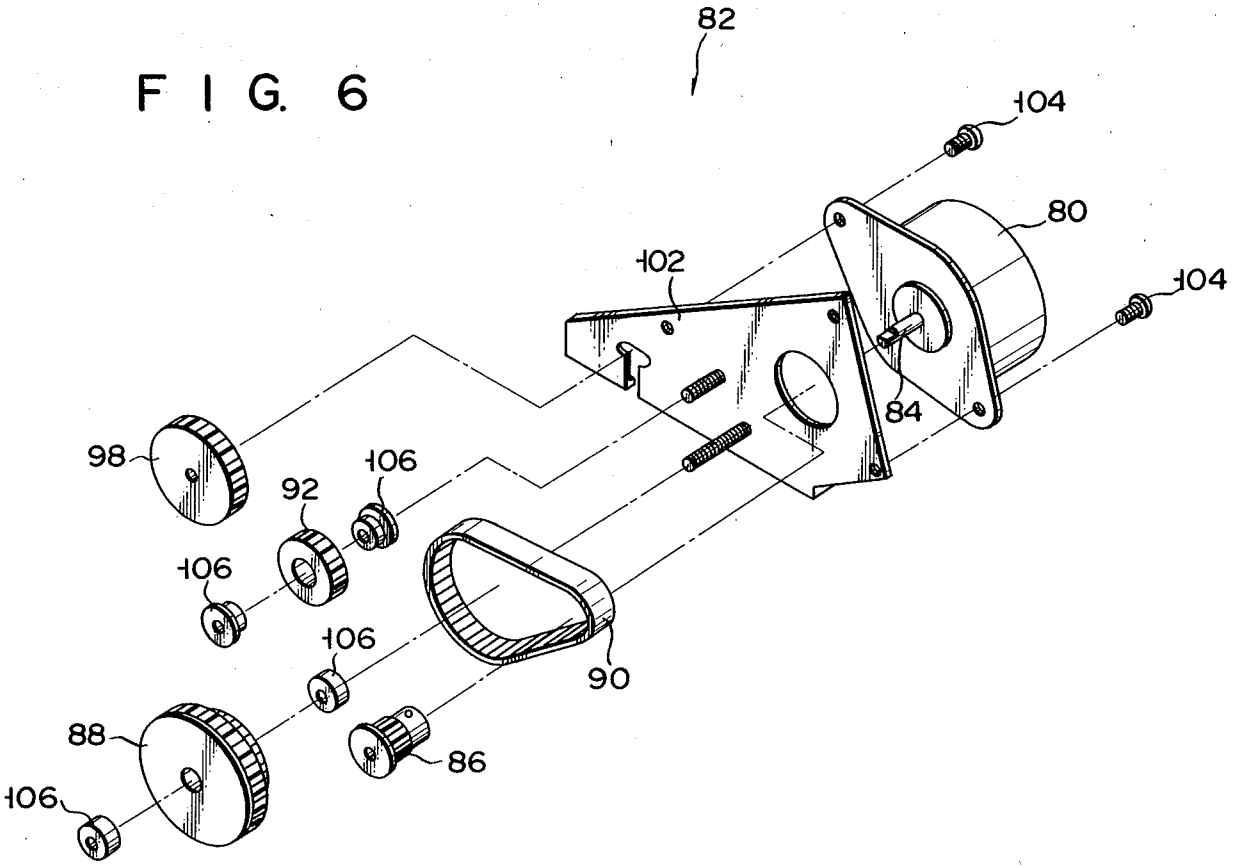
FIG. 6 is a perspective view showing a first power transmitting section in FIG. 5 developed.
Figure 7:
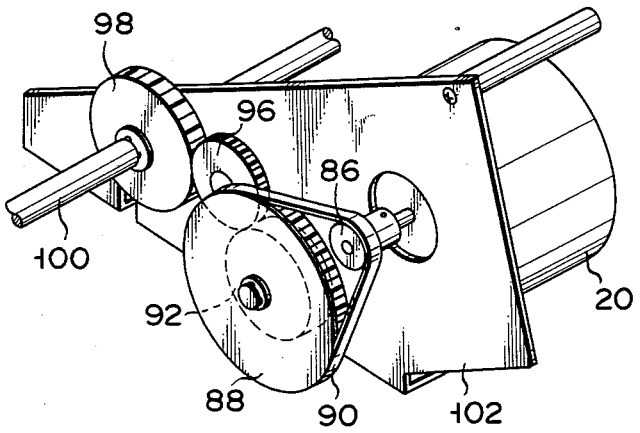
FIG. 7 is a perspective view showing the power transmitting section of FIG. 6 assembled.

As shown in detail in FIGS. 6 and 7, the first power transmitting system 82 includes a first pully 86 attached to a shaft 84 of the motor 80, and a second pulley 88 to which the rotation of the first pully is transmitted. Stretched between the first and second pulleys 86 and 88 is a first timing belt 90 for transmitting power. A first idle gear 92 is attached to the second pulley 88 through a first shaft 94 and rotates integrally with the second pulley 88. A first drive gear 98 is engaged with the first idle gear 92 through a second idle gear 96, and is supported by a second shaft 100. In FIG. 6, numeral 102 represents a plate for supporting the motor 80 and shafts; 104, screws for attaching the motor to the plate; and 106, stopper members for attaching the gears or pulleys to the shafts.

A second drive gear 110 is connected to one end of the second shaft 100 via a first one-way clutch 108. The second drive gear 110 is engaged with a third drive gear 112 which is fixed to one end of the lower separating roller shaft 74, which is thus rotated integrally with the third drive gear 112. A third pulley 114 is fixed to the lower separating roller shaft 74 between the third drive gear 112 and the left lower separating roller 43. A second timing belt 118 is stretched between the third pulley 114 and a fourth pulley 116, which is fixed to the first arm shaft 72, so as to transmit the rotation of the third pulley 114 to the fourth pulley 116. The first arm shaft 72 is connected to a second power transmitting system 122, which will be described later. A pulley 120 is in contact with the second timing belt 118 for adjusting the tension of the belt 118.

A fifth pulley 126 is connected to the other end of the second shaft 100 via a second one-way clutch 124. A third timing belt 130 is stretched between the fifth pulley 126 and a sixth pulley 128 to which the rotation of the fifth pulley 126 is transmitted. A pulley 132 is in contact with the third timing belt 130 for adjusting the tension of the belt 130. The sixth pulley 128 is fixed to one end of a sixth shaft 134, to the other end of which is fixed a fifth drive gear 138 engagable with a fourth drive gear 136 fixed to one end of the lower resist roller shaft 78. The rotation of the motor 80 is transmitted to the lower resist roller shaft 78 to rotate the resist rollers 48 and 46.

Since the upper resist rollers 46 are fixed to the rotatable upper resist roller shaft 76, they are rotated when pressed by the lower resist rollers 48 urged by an urging member (not shown).

Fixed to the center portion of the sixth shaft 134 is a sixth drive gear 140, which is connected to a third drive power transmitting section 142 for transmitting power to the conveyor 6. The third drive power transmitting section 142 will be described later.

A seventh pulley 144 is fixed to the second shaft 100 between the first drive gear 98 and the fifth pulley 126. A fourth timing belt 150 is stretched between the seventh pulley 144 and an eighth pulley 148 so as to transmit rotation power to each other, said eighth pulley 148 being fixed to a seventh shaft 146 which serves to transmit rotation to the feeding rollers 44. For adjusting the tension of the belt 150 and preventing the transmission of reverse rotation of the motor 80 to the belt 150, a rubber-coated pulley 152, which has one-way clutch for controlling the feeding direction to keep one way direction, is provided in contact with the fourth timing belt 150. A pulley 152 is in contact with the fourth timing belt 150 for adjusting the tension of the belt 150. A first drive sprocket 155 for transmitting drive force to the feeding rollers 44 is fixed to the seventh shaft 146. An engagement means 158, which will be described later, and which serves to connect and disconnect the clutch 154 is located adjacent to the clutch 154.

Figure 8:
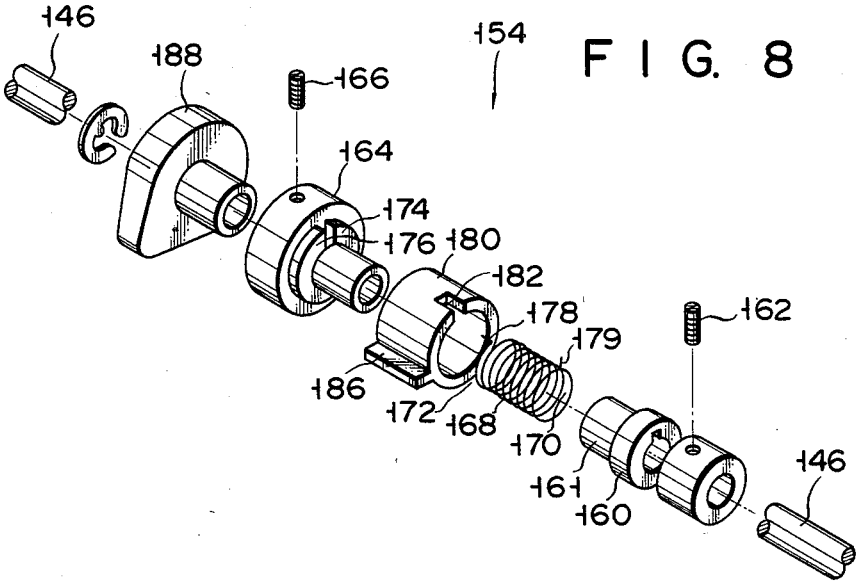
FIG. 8 is a perspective view showing the clutch in FIG. 5 disassembled.

The clutch 154 will be described with reference to FIG. 8. Fixed to one end of the seventh shaft 146 by means of a screw 162 is a first boss member 160 having a stepped portion 161. A second boss member 164 is provided on the seventh shaft 146 so as to rotate integrally with the seventh shaft 146. One end portion 170 of a spring joint 168 is fitted onto the stepped portion 161 of the first boss member 160 while the other end portion 172 thereof is fixed to the second boss member 164. Namely, a stepped portion 174 of the second boss member 164 is provided with a groove 176 with which one end of the spring joint 168 is engaged. A sleeve 180 is fitted onto the spring joint 168 and provided with a groove 182 which can be engaged with the other end 179 of the spring joint 168. Formed integral with the outer circumference of the sleeve 180 is a projection 186 with which a lever 184 can be engaged. A cam 188 is fixed to the second boss 164 by means of screw 166 for adjusting the position thereby transmitting drive power to the stopper 36, said cam 188 being rotated integrally with the seventh shaft 146 by means of clutch 154.

According to this arrangement of the clutch 154, the rotation of the sleeve 186 is stopped when the lever 184 is engaged with the sleeve 186, so that slippage occurs between the spring 168 and the stepped portion 161 of the first boss member 160 thereby preventing the rotation of the seventh shaft 146 from being transmitted to the cam 188. When the sleeve 180 is released from the lever 184, the sleeve 180 is left free, so that the spring joint 168 is rotated by the friction between the spring joint 168 and the stepped portion of the first boss member 160. As a result, the rotation force of the seventh shaft 146 is transmitted to the cam 188.

Figure 9:
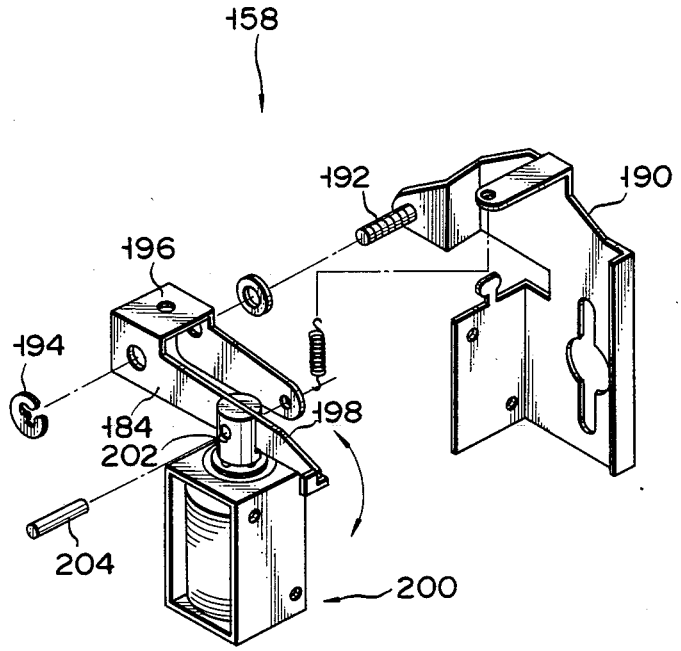
FIG. 9 is a perspective view showing a mechanism for connecting and disconnecting the clutch shown in FIG. 5.

The engagement means 158 which is engaged with the clutch 154 will be described referring to FIG. 9. The engagement means 158 includes a box-shaped body 190 on which a support shaft 192 is formed for rotatably supporting the lever 184, which can be engaged with the projection 186 of the sleeve 180. The lever 184 is rotatably supported by the support shaft 192, using a stopper ring 194. One end of the lever 184 is provided with a flat striker portion 196 to strike the projection 186 of the sleeve 180, while the other end 198 thereof is fixed to a plunger 202 in a solenoid 200 by means of a pin 204. A solenoid is formed around one end of the plunger 202 to rotate the lever 184 when excited.

Figure 5:
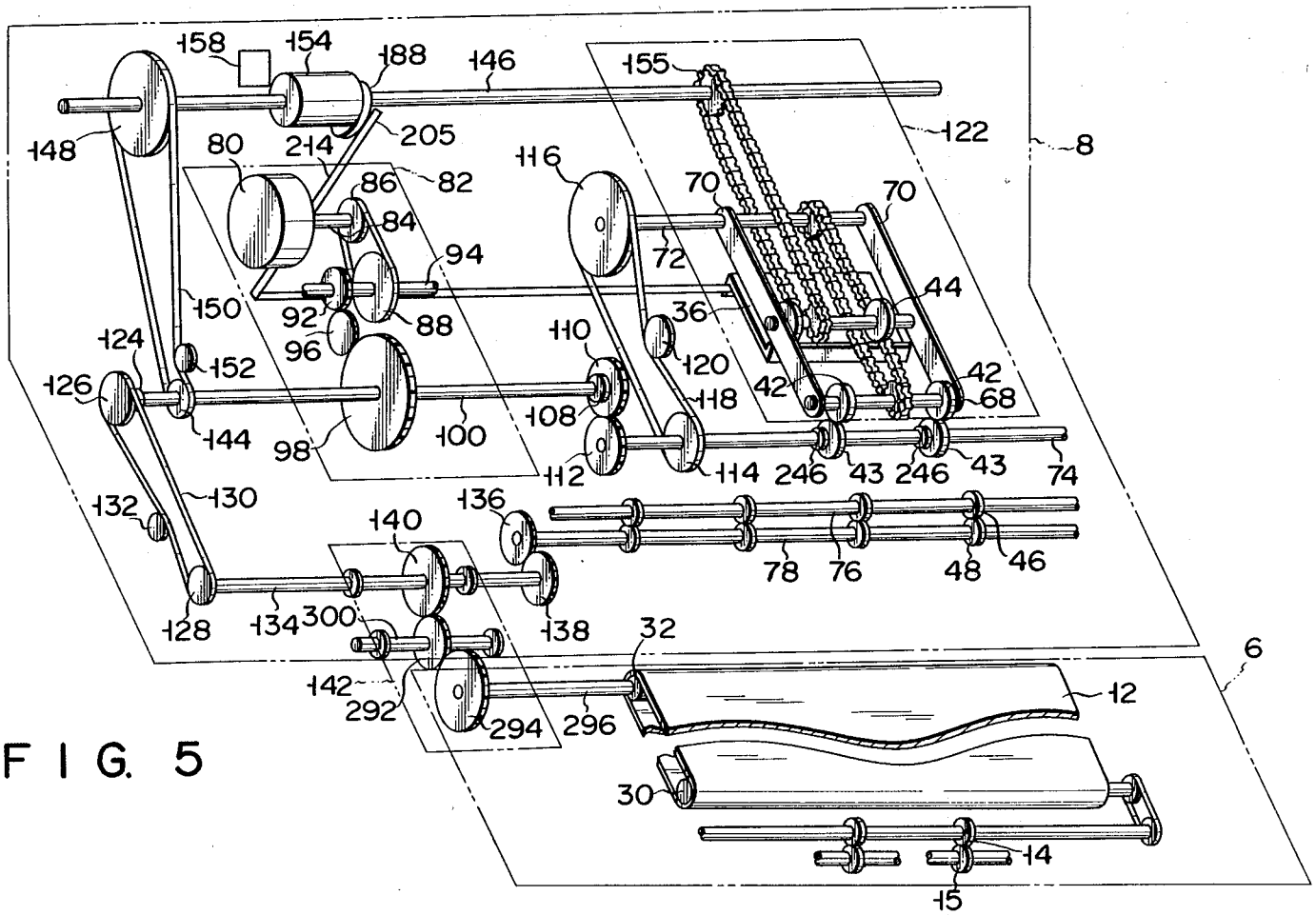
FIG. 5 shows a driving mechanism employed in the automatic document feeding apparatus of FIG. 1.

As shown again in FIG. 5, one end portion 215 of the arm 214 contacts the cam 188 at an outer circumference thereof. The other end portion 213 of the arm 214 is fixed to one end portion of a ninth shaft 208 for swinging the stopper 36, so the ninth shaft 208 can be rotated by the rotation of the arm 214.

Figure 11:
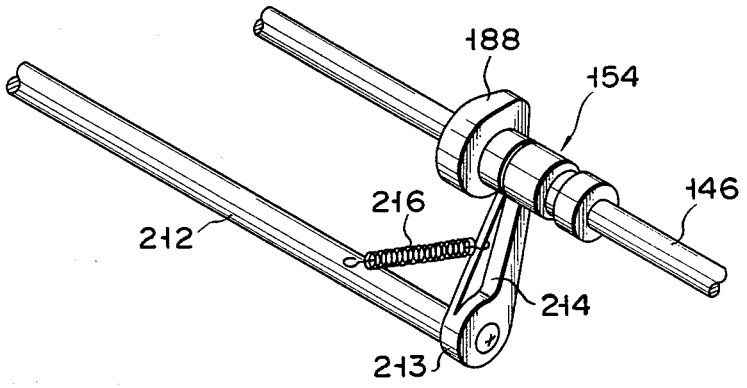
FIG. 11 is a perspective view showing the cam lever in FIG. 10.
Figure 10:
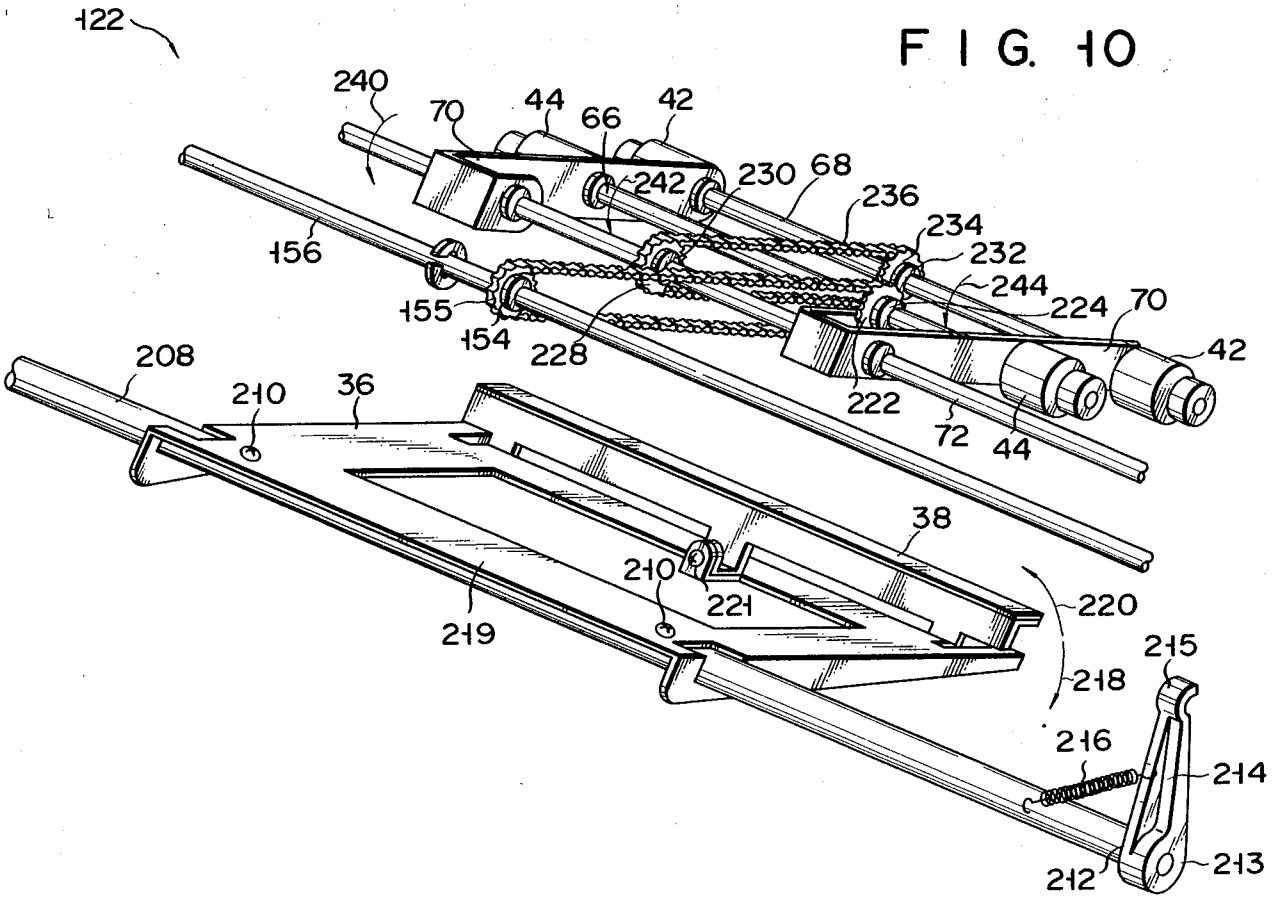
FIG. 10 is a perspective view showing the second power transmitting section in FIG. 5.

The second power transmitting system 122 will be described referring to FIGS. 10 and 11.

In the second power transmitting system 122, the other end portion 219 of the stopper 36 is fixed to the ninth shaft 208 by screws 210. Said the other portion 213 of a lever 214 is a fixed to the one end portion 212 of the ninth shaft 208 so as to rotate integrally with the ninth shaft 208. The other end portion 215 of the cam lever 214 contacts the cam 188 at an outer circumference thereof. Attached to the cam lever 214 is a spring 216 for urging the ninth shaft 208 in a counter-rotation direction. According to this arrangement, the striker portion 38 of the stopper 36 is rotated in the direction shown by an arrow 218 and projected above the document table 22 when the cam lever 214 is rotated. It is urged by the spring 216 to rotate in a direction shown by an arrow 220; i.e., it is returned below the document table 22 when the cam lever 214 is not rotated. Numeral 221 represents stud for attaching the striker portion 38 to the stopper 36 so that it can swing slightly.

A second drive sprocket 222 is attached via a one-way clutch 224 to the feeding roller shaft 66 to which the feeding rollers 44 are fixed. A chain 226 is stretched between the second drive sprocket 222 and the first drive sprocket 155 to transmit the rotation force of the first sprocket 155 to the feeding rollers 44.

A third drive sprocket 228 is attached via a one-way clutch 230 to the arm shaft 72 which is rotated by the motor 80, as already described above. A fourth drive sprocket 234 is attached to the shaft 68 for the upper separating rollers 42 via a one-way clutch 232. A chain 236 is stretched between the third and the fourth drive sprockets 228 and 234 to transmit the rotation force of the first arm shaft 72 to the upper separating rollers 42.

According to the arrangement of the second power transmitting system 122 as described above, the first arm shaft 72, feeding roller shaft 66 and upper separating roller shaft 68 are rotated by the one-way clutches 230, 224 and 232, which are attached to these shafts, respectively, in the direction shown by arrows 240, 242 and 244 only.

When the upper separating rollers 42 are rotated following the rotation of the upper separating roller shaft 68, rotation force is transmitted to the lower separating rollers which contact the upper separating rollers 42. As shown in FIG. 3, however, a rotation force opposite to that of the upper separating rollers is transmitted from the third drive gear 122 to the lower separating roller shaft 74 which supports the lower separating rollers 43. The lower separating roller shaft 74 is therefore provided with limited power transmitting means 246 adjacent to the lower separating rollers 43 to limit the rotation force opposing to each other and to enable the separating rollers 42 and 43 to reliably separate the documents one by one.

Figure 12:
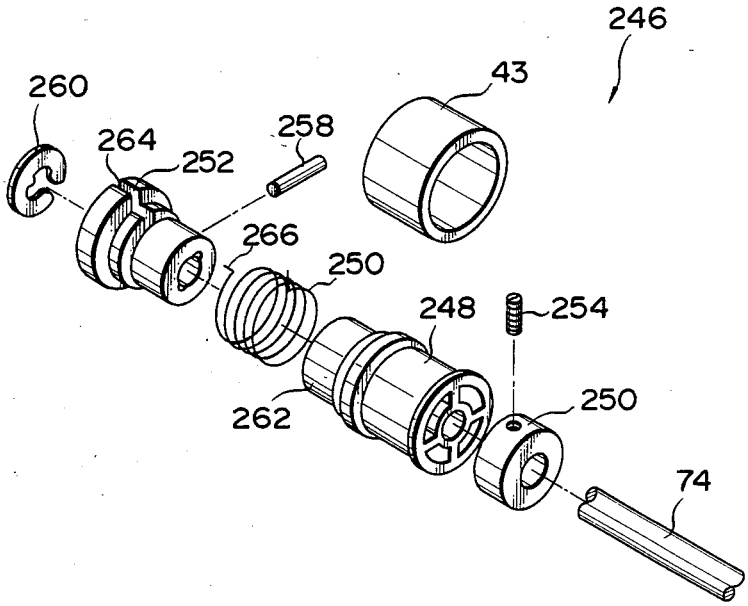
FIG. 12 is a perspective view showing a development of the limited power transmitting mechanism in FIG. 5.
Figure 13:
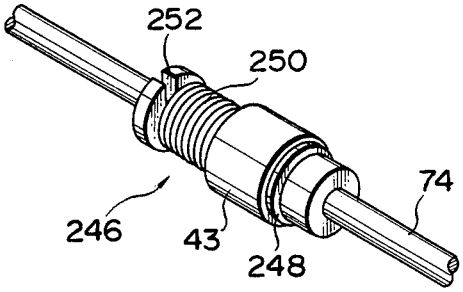
FIG. 13 is a perspective view showing the limited power transmitting mechanism of FIG. 12 assembled.

These limited power transmitting means 246 will be described referring to FIGS. 12 and 13.

Fixed to the lower separating roller shaft 74 are a roller boss 248 and a spring support member 252 for engaging with a spring 250. The roller boss 248 is fixed to the lower separating roller shaft 74 by a screw and a support member 256 which supports the roller boss 248 and the lower separating rollers 43 are fixedly fitted onto the roller boss 248. The spring support member 252 is fixed to the lower separating roller shaft 74 by a pin 258 and a stopper ring 260. The roller boss 248 is provided at one end thereof with a projection 262 onto which the spring 250 is fitted. The spring support member 252 is provided with a groove 264 which can engage with the spring 250 and with which one end 266 of the spring 250 is engaged. The body of the spring 250 is fitted onto the projection 262 with a predetermined friction force. Friction force between the spring 250 and the projection 262 enables the rotation force of the lower separating roller shaft 74 to be transmitted to the lower separating rollers 43.

According to these limited power transmitting means 248, slippage occurs between the spring 250 and the projection of the roller boss 248 to thereby cause the lower separating rollers 43 to be reversely rotated, when predetermined retarding torque (which corresponds to the above-mentioned friction force) is applied to the roller boss 248 through the lower separating rollers 43.

Figure 14:
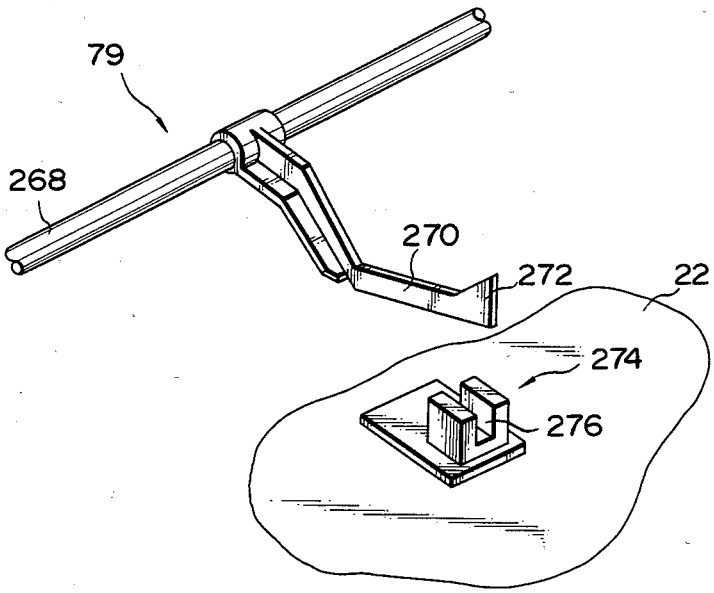
FIG. 14 is a perspective view showing a sheet detecting mechanism.

The document detecting mechanism 79 shown by the two-dot-dash line in FIG. 3 and serving to detect whether or not any documents are stacked on the document table will be now described referring to FIG. 14.

In the document detecting mechanism 79, one end of a reverse L-shaped lever 270 is rotatably attached to a rod 268 fixed to the chamber 24 (not shown). The other end of the lever 270 is engageable with a detector 274 which will be described later. The detector 274 engageable with the other end 272 of the lever 270 is arranged on the document table 22 and under the lever 270. The detector 274 is provided with a groove 276 through which the other end 272 of the lever 270 passes, to interrupt a light. When the other end 272 of the lever 270 passes through the groove 276, the light is interrupted, which is detected by detector 274. More specifically, when the documents are present between the lever 270 and the detector 274, the other end 272 of the lever 270 is laid on the documents and, not engaged with the detector 274. The detector 274 thus detects the presence of documents. When no document is present between the lever 270 and the detector 274, the lever 270 rotates relative to the rod 268 by its own weight and passes through the groove 276 of the detector 274 with its end 272. The detector 274 detects the absence of documents, accordingly. When the detector 274 detects the presence or absence of documents, it supplies a display signal to a display (not shown) in the body of the copying machine 2 to display the result.

The operation of the document feeding apparatus 8 will be described in detail with reference to FIGS. 15 through 23.

Figure 15:
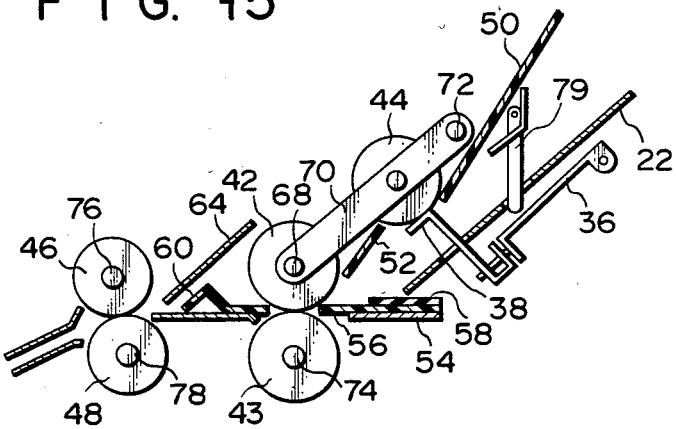
FIGS. 15 through 23 are sectional side views showing the operation of the main section of the automatic document feeding apparatus shown in FIG. 2.

FIG. 15 shows a condition where no document is stacked on the document table 22 yet. The striker portion 38 of the stopper 36 is projected above the document table 22 in this condition.

Figure 16:
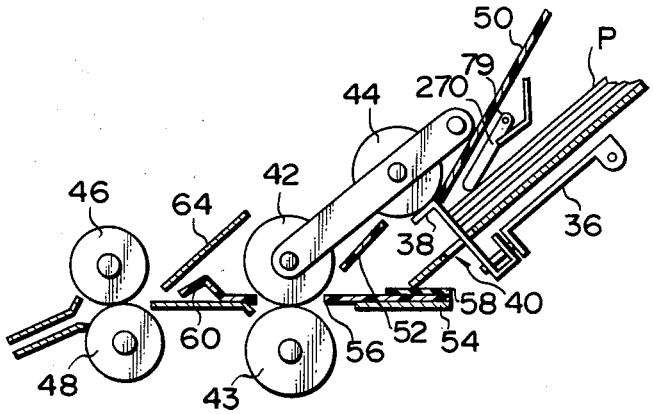

As shown in FIG. 16, the documents P are laid in a stacked state on the document table 22. The documents are stopped halfway to the oblique document table 22 by the stopper 36. The leading edges of the documents strike against the stopper 36 and thus are made even. Since the lever 270 of the document detecting mechanism 79 is lifted, the detector 276 (shown in FIG. 14) detects the presence of the documents and causes this to be displayed.

When a start button (not shown) on the body 4 of the copying machine is pushed, the motor shown in FIG. 5 is actuated to rotate the first pulley 86 in a predetermined direction. The solenoid in the engagement means 158 (see FIG. 9) is excited at the same time to connect the clutch 154 (see FIGS. 5 and 8).

Figure 17:
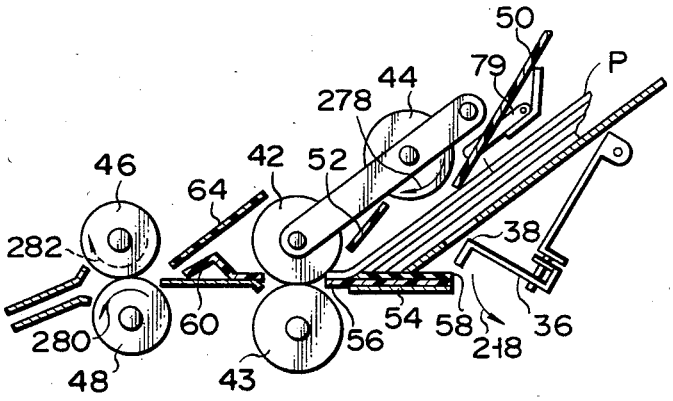

When the stopper 36 is swung below the document table 22 along the direction shown by the arrow 218, the documents P stopped by the stopper 36 slide down, while being guided by the first guide member 50, on the document table 22 toward the friction control member 58, as shown in FIG. 17. The leading edges of the originals are successively shifted from one another here on the friction control member 58. The lower documents are stopped here on the friction control member 58 because of the weight of those documents which are stacked on them and because a large friction force is thus generated between the lower documents and the friction control member 58. The upper documents, however, have less friction than the friction control member 58. Therefore, some upper documents including the top one pass over the friction control member 58 and are guided by the third guide members 56 to a position adjacent to the separating rollers 42. On the other hand, the feeding rollers 44 are rotated in the direction shown by arrow 278. However, the feeding rollers 44 are not brought into contact with the top document P1. The resist rollers 46 and 48 are rotated in the direction of arrow 282 and 280, respectively.

Figure 18:
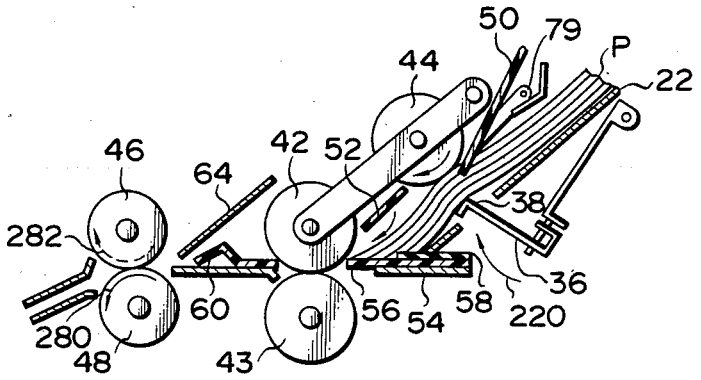

The stopper 36 is swung along the arrow 220, as shown in FIG. 18. Its striker portion thus lifts the documents stacked on the document table. The top document is brought into contact with the feeding rollers by this operation of the stopper and sent between the separating rollers 42 and 43 by the rotating feed rollers.

Figure 19:
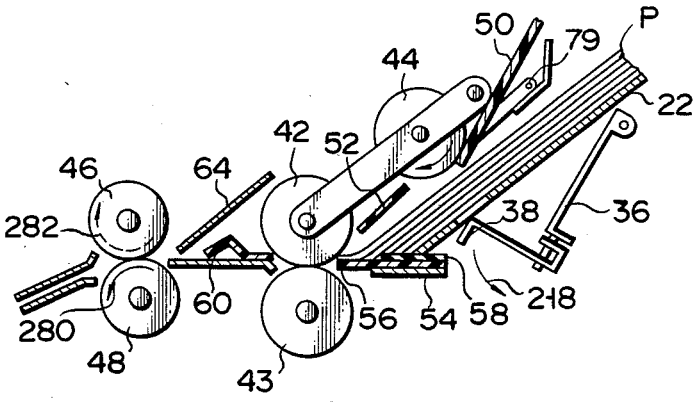

After about 1/6 seconds, the stopper 36 is swung in the direction of the arrow 218 as shown in FIG. 19. Namely, the striker portion 38 is moved below the document table. The top document P1 is separated from the feeding rollers 44.

Figure 20:
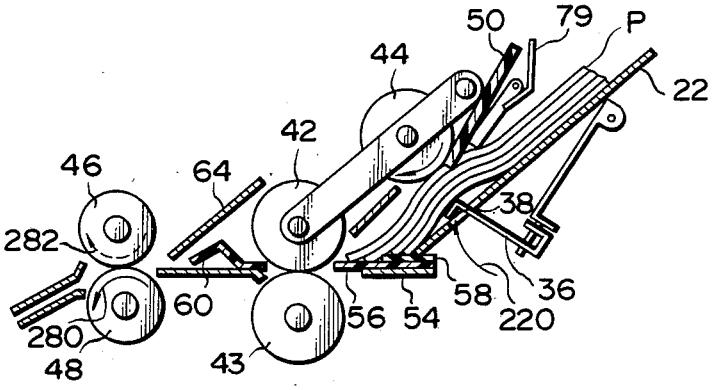

After another 1/6 seconds, the stopper 36 is again swung along the arrow 220, causing its striker portion 38 to lift the documents on the document table, as shown in FIG. 20. The top document this time is again brought into contact with the feeding rollers 44 and thus moved toward the separating rollers.

As described above, the documents P1 are fed one by one from the top document P1, about three times per second in this embodiment, toward the separating rollers 42 and 43. Namely, the stopper 36 is swung about three times per second in the direction shown by the arrow 220. This operation of the stopper 36 enables only the top document to be reliably fed between the separating rollers 42 and 43. Even if a number of documents including the top one happen to be sandwiched between the separating rollers 42 and 43, these documents can be conveyed one by one from the top toward the resist rollers 46 and 48 thanks to the separating capacity of the separating rollers. Conventionally, there was a drawback of often feeding those documents that could not be separated toward the separating rollers. According to this embodiment, however, even if a number of sheets of documents should be fed because of the effect created between the feeding rollers and the stopper 36, their number is so small that they can be reliably separated one by one from the top between the separating rollers 42 and 43.

Even if the feeding rollers 44 should feed a plurality of documents, they necessarily include the top document and therefore, the separating rollers 42 and 43 can reliably separate them one by one from the top (P1).

Figure 21:
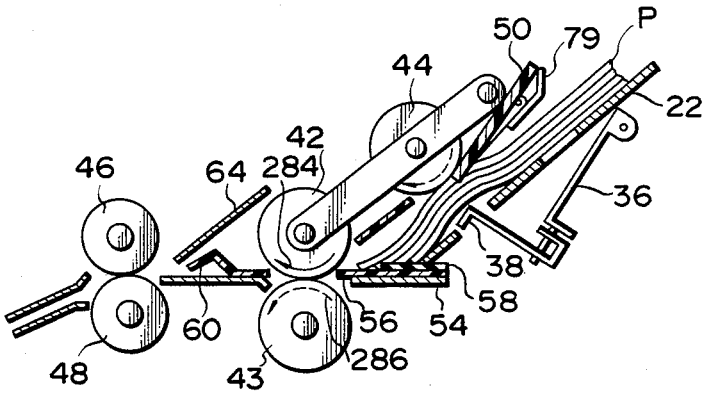

As shown in FIG. 21, the top document can be fed far enough into the separating rollers 42 and 43 by the feeding rollers 44 and the stopper 36. The motor 80 shown in FIG. 5 is then reversely rotated after the lapse of a brief delay. The upper separating rollers 42 are thus rotated in the direction of arrow 284. As a result, the lower separating rollers 43 in contact with the upper separating rollers 42 are rotated in the direction of arrow 286, but a rotation force reverse to the arrow 286 is applied to the lower separating rollers 43. Rotations of these upper and lower separating rollers 42 and 43 will again be described while referring to FIG. 5.

When the motor 80 rotates reversely, the rotation force of the motor 80 is transmitted to the lower separating roller shaft 74 through the third drive gear 112. The rotation force of the lower separating roller shaft 74 is transmitted to the upper separating rollers 42 through the lower separating rollers 43, pulleys 114, 116 and first arm shaft 72. In the case of reverse rotation of the motor 80, the rotation force is not transmitted to the resist rollers 46 and 48 because of a second one-way clutch attached to one end of the second shaft.

In the embodiment, the upper separating rollers 42 rotate in the direction of the arrow 284 at a low speed such as about 100 mm/sec., for example. Rotation force in the direction of the arrow 286 is applied from the upper separating rollers 42 to the lower ones 43, but another rotation force reverse to the arrow 286 is applied from the lower separating roller shaft to the lower separating rollers 43. In short, friction between the upper and the lower separting rollers is larger than the torque transmission force due to the above-described limited power transmitting means, so that the lower separating rollers 43 can be rotated in direction of the arrow 286.

Figure 22:
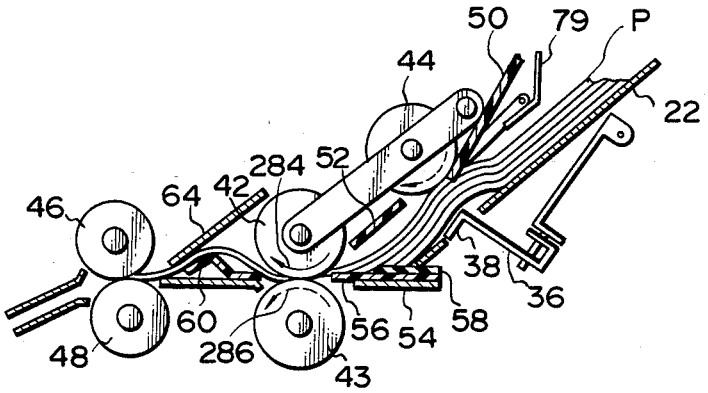

When only one document is reliably inserted between the separating rollers 42 and 43, it is fed between the stopped resist rollers, as shown in FIG. 22. This document is guided and waved by the upper guide 64 and the fourth guide members between the separating rollers 42, 43 and the resist rollers 46, 48. The leading edge of the document reaches between the resist rollers 46 and 48 and is lined up by its wave. The motor 80 then stops temporarily.

Figure 23:
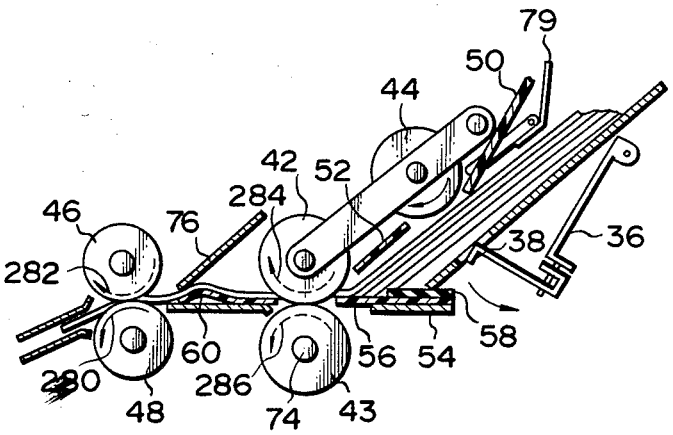

The motor 80 shown in FIG. 5 is then again rotated in the positive direction. The rotation of the motor 80 is transmitted to the lower resist roller shaft 78 through the second one-way clutch 124, fifth pulley 126, sixth pulley 128, fifth drive gear 138 and fourth drive gear 136. As a result, the resist rollers 46 and 48 are rotated in the direction of arrows 282 and 280, respectively, as shown in FIG. 23. The document (P1) is conveyed by the rotation of the resist rollers 46 and 48 toward the conveyor (see FIG. 2). The separating rollers 42 and 43 are not rotating at this time. Therefore, the document is fed at the leading edge thereof with its back edge sandwiched between the separating rollers 42 and 43 and thus drawn toward the conveying direction. The separating rollers 42 and 43 are rotated by this tension of the document to thereby convey the document. In this case, the foremost ends of the fourth guide members are left free and the reverse V-shaped projections of the fourth guide members are therefore flattened by the tension of the document, so that no unwanted force is applied to the document conveyed to tear it. The document is thus fed to the conveyor.

The separating operation in a case where a plurality of documents are pulled in between the separating rollers 42 and 43 will be described referring to FIGS. 24 through 27.

Figure 24:
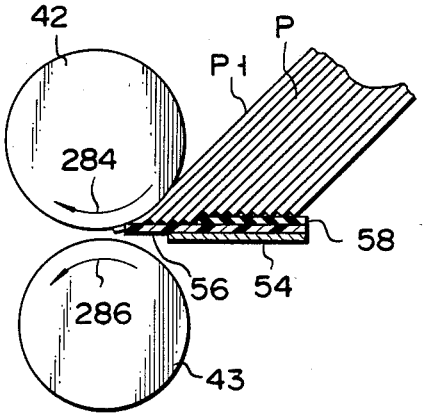
FIGS. 24 through 27 are sectional side views showing the documents separated from one another when pickup rollers shown in FIG. 3 pick up documents therebetween.
Figure 25:
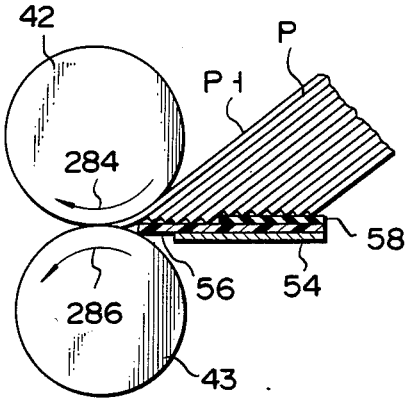
Figure 26:
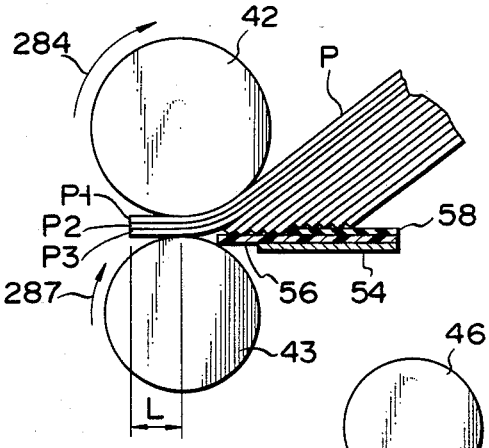
Figure 27:
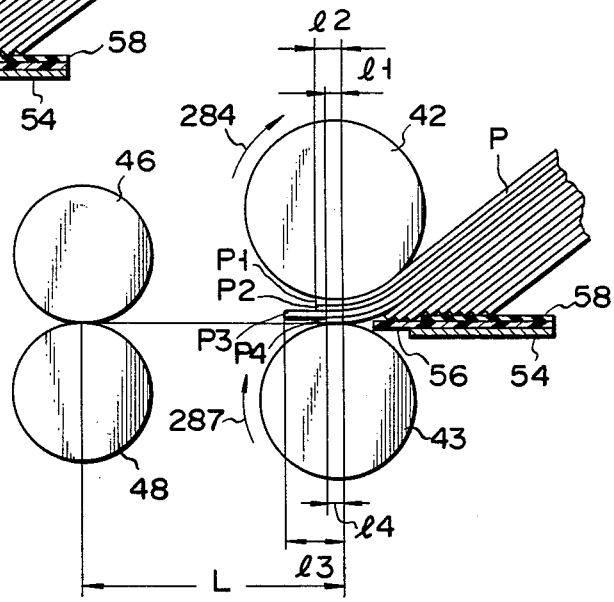

FIG. 24 shows a state where the documents are about to be pulled in between the separating rollers. The foremost edges of the first, second and third documents P1, P2 and P3, out of the stack of documents, may not be trued up, as shown in FIGS. 24 and 25. In this case, the document P3 is first inserted between the separating rollers 42 and 43. Then, the first or top document P1 touches the upper separating rollers 42 to be transferred by friction. The document P1 transmits a conveying force to the adjoining document P2 via the friction force between them, thereby transferring the document P2 in that direction.

However, the lower separating rollers 43 are urged to rotate in the direction of arrow 287 by the limited power transmitting means 246. When the rotation force in the direction of arrow 286 is transmitted through the lower separating rollers 43 to the document P3, the documents P3 and P2 are successively returned since the friction force between the document P3 and the lower separating rollers 43 is larger than that between the documents P2 and P3.

In this embodiment, the peripheral speed of the lower separating rolles 43 is about three times that of the upper separating rollers 42. Therefore, if the document P1 in contact with the upper separating rollers 42 advances 10 mm after the documents P1, P2 and P3 are fed together or the instant that the documents start to be separated, then the document P3 in contact with the lower separating rollers 43 will be returned approximately 30 mm.

Here, let us suppose that the distances from the contact portion between the upper and the lower separating rollers 42 and 43 to the foremost edges of the documents P2 and P3 at the instant that the documents start to be separated are L and X, respectively. If X is 30 mm or less, the document P2 in contact with the document P3 is quickly returned by the distance L-X. As this action is repeated, the documents P2 and P3 are fed back and separated. When the lower separating rollers 43 touch the document P1, that is, when only the document P1 is left between the upper and the lower separating rollers 42 and 43, the sum of the friction forces between the document P1 and the lower separating rollers 43 and between the document P1 and the upper separating rollers 42 is greater than the rotation force in the direction of arrow 287 transmitted through the limited power transmitting means 246, as mentioned before. Thus, the rotation force of the upper separating rollers 42 transmitted through the document P1 to the lower separating rollers 43 surpasses the rotation force in the direction of arrow 287 transmitted through the limited power transmitting means 246, so that the lower separating rollers 43 are rotated in the direction of arrow 286. Thus, the document P1 is transferred in the feeding direction.

The separting capability of the separating rollers 42 and 43 may be expressed as follows:

$$3(L-l_1)>l_2+l_3+\ldots+l_N$$

Where L (FIG. 27) is the distance from the center line connecting the axes of the separating rollers 42 and 43 to the contact portion between the resist rollers 46 and 48, (FIG. 27) is the distance from the center line to the leading edge of each of the originals held in layers between the separating rollers 42 and 43, $V_F$ is the peripheral speed of the upper separating rollers 42, $V_B$ is the peripheral speed of the lower separating rollers 43, and $3V_F=V_B$. Thus, the number of separable originals is N which satisfies the above equation.

The third drive force transmitting mechanism 142 which transmits driving force to the conveying belt means 6 will be described referring to FIGS. 5 and 28.

An eighth drive gear 294 is engaged with the sixth drive gear 140 via a seventh drive gear 292, as shown in FIG. 5, and the rotation of the motor 80 is transmitted to the sixth drive gear 140. The eighth drive gear 294 is fixed to a belt roller shaft 296 which serves to rotate the belt roller 30 around which the conveying belt 12 passes. The third drive force transmitting section 142 is adapted not to transmit driving force when the conveyor 6 is in an open position as shown in FIG. 1 but to transmit driving force when the conveyor 6 is in a closed position. This will be described referring to FIG. 28.

The seventh drive gear 292 is rotatably supported by a holder arm 298 through a ninth shaft 300 (see FIG. 5), said holder arm 298 being rotatably attached to the sixth shaft 134. Fixed to one end 302 of the holder arm 298 is one end of a spring 304, the other end of which is fixed to the body 4 of the copying machine 2, thereby urging the holder arm 298 around the sixth shaft 134 in the direction of an arrow 306. A control member 308 for controlling the rotation of the holder arm 298 is arranged at that position on the body 4 which is adjacent to one end 302 of the holder arm 298. Arranged on a side of the seventh drive gear 292 is a first pitch circle disc 310 which rotates integrally with the seventh drive gear 292 and which has a radius equal to that of the pitch circle of the seventh drive gear 292. Similarly, a second pitch circle disc 312 is arranged on a side of an eighth drive gear 294 and contacts the first pitch circle disc 310 on their outer circumferences.

Figure 28:
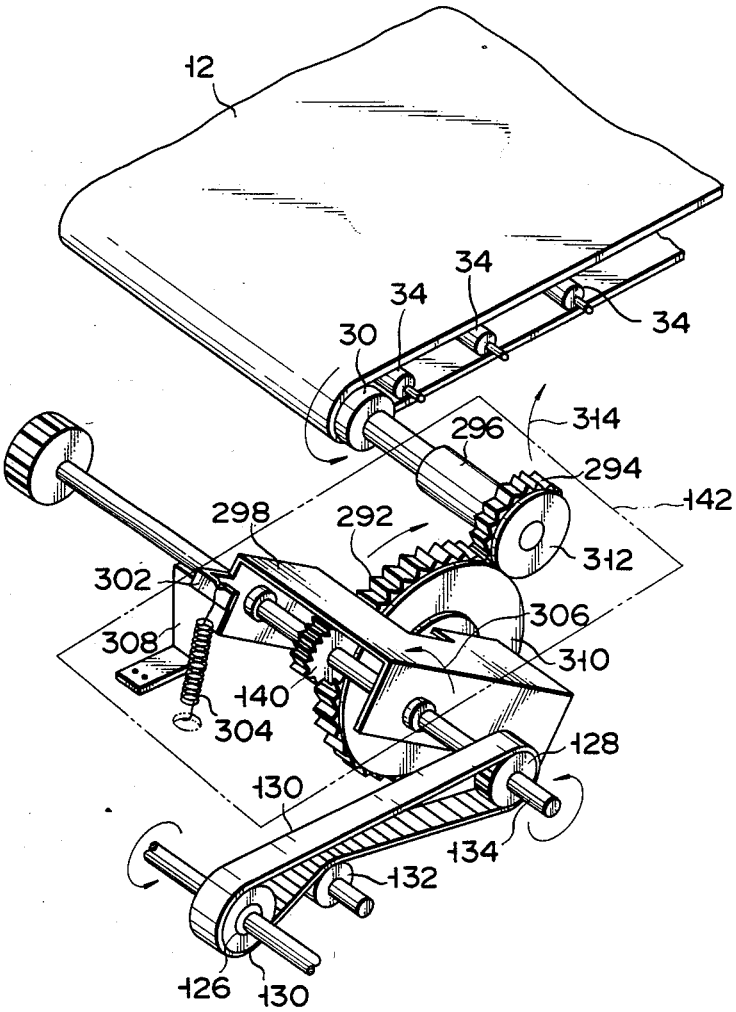
FIG. 28 is a perspective view showing the conveying belt means and its driving mechanism.

FIG. 28 shows the state of the third drive power transmitting section when the conveyor 6 is closed. When the conveyor 6 is brought into an open position, the eighth drive gear 294 moves in the direction of an arrow 314 to be released from the seventh drive gear 292, thereby preventing power from being transmitted to the eighth drive gear 294. The conveying belt 12 is, accordingly, not driven.

When the conveying belt means 6 is closed, the eighth drive gear 294 is engaged with the seventh drive gear 292 against the action of the spring 304. Upon the engagement of these two gears, the first and second pitch circle discs 310 and 312 arranged on their corresponding sides of the gears, respectively, are brought into contact with each other. The distance between the center axial line of the seventh drive gear 292 and the center axial line of the eighth drive gear 294 can be thus controlled. Even when a tooth of the seventh drive gear 292 comes face to face with a tooth of the eighth drive gear 294 upon the engagement of these two gears, the seventh drive gear 292 is urged against the eighth drive gear 294 so that they can be engaged with each other, with their teeth fitted into their teeth grooves, at the instant that the seventh drive gear 292 is driven.

The pitch circle discs arranged in the third drive power transmitting section prevent noise, vibration and irregular wearing of the gears during power transmission.

An original stopper mechanism 316 including the document stopper member 20 for stopping the document conveyed from the conveyor at the predetermined position on the exposing table will be described referring to FIGS. 29 and 30.

Figure 30:
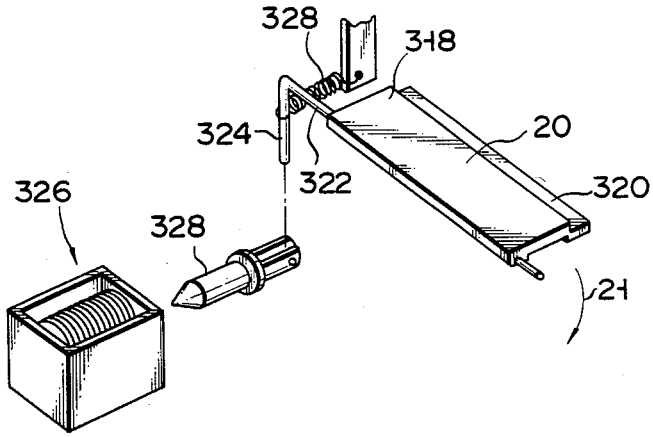
FIG. 30 is a perspective view showing the document stopping mechanism in FIG. 29 developed.

The document stopper member 20 has an upper step portion 318 and a lower step portion 320, as shown in FIG. 30. An L-shaped rod 322 is fixed to one end of the document stopper member 20. One end 324 of the rod 322 is connected to a plunger 328 which is moved in one direction when excited by a solenoid 326. Fixed to the one end 324 of the rod 322 is one end of a spring 328 for urging the rod 322 against the movement of the plunger. The other end of the spring is fixed to the body 4 of the copying machine 2. According to this arrangement, the document stopper member 20 is rotated in the direction of the arrow 21 when the solenoid is excited.

Figure 29:
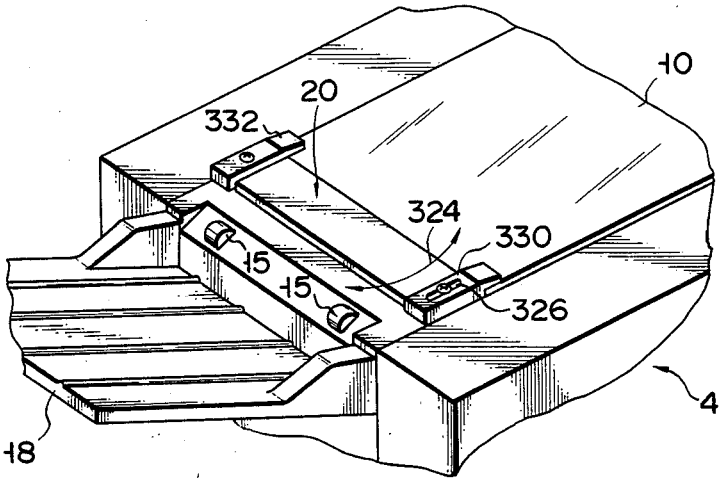
FIG. 29 is a perspective view showing a document stopping mechanism in FIG. 1.

As shown in FIG. 29, the rod 322 is supported by stopper holders 330 and 332 on the exposing table 10 in such a way that it can move in both directions of an arrow 324. The document stopper member 20 fixed integral to the rod 322 is therefore moved in the direction of the arrow 324, but its movement is limited by a slot 326 in the holder 330. More specifically, the stop position of the document fed can be adjusted by this slot in the holder 330 and determination of the document stop position can be achieved by a screw 328 fitted into the slot 326.

The document temporarily stopped by the document stopper member 20 is again conveyed by the conveying belt to the tray 18 through the discharging rollers 14 and 15, because when the solenoid means 326 is excited after light exposure, the document stopper member is rotated in the direction of the arrow 21 to release the document stopper mechanism (see FIG. 2), thereby rendering the conveying belt operative again.

According to this embodiment, the documents stacked on the document table are intermittently brought into contact with the feeding rollers and forcedly fed between the separating rollers successively from the top of the stacked documents, thereby enabling the documents to be reliably and successively fed one by one from the top of the stack.

The present invention is not limited to the one embodiment described above, but various changes and modifications may be made within the scope or spirit of the present invention.

In the above embodiment, the apparatus of the present invention has been described as a document feeding apparatus used in copying machines. However, the document of sheet feeding apparatus of the present invention may also be used with the same effect in automatic banking machines which accept stacks of bank notes.

The pressing means has pressed the stacked documents from below the document table to intermittently contact the top of the stacked documents with the feeding rollers, but it may be arranged so that the feeding rollers are pressed toward the document table to contact the top of the documents stacked on the document table.

Contact between the feeding rollers and the top document has been set at three times per second, but it may be set at other times such as two, four or five times per second if the contact is achieved intermittently.

Rotatable rollers have been used as the feeding means which intermittently contact the top of the stacked documents to feed them, but frictional members may be employed, which can move in the feeding direction, or an arrangement for sucking up the top of the stacked documents is also feasible.

What is claimed is:

1. A sheet feeding apparatus for successively feeding sheets one by one from the top of stacked sheets, comprising:

a sheet table arranged oblique to the direction of gravity on which the sheets are stacked pressing/stopping means having a member moveable to a position projecting at an intermediate portion of the sheet table for stopping the sheets on the intermediate portion of the sheet table when the member initially projects above the sheet table and which allows the sheets to move past the intermediate portion of the sheet table when the member is moved to a position below the sheet table;

feeding means arranged contactable with the top of the sheets stacked on the sheet table and serving to pick up the top sheet when in contact with it, and to feed it from the sheet table;

said member of said pressing/stopping means being intermittently moved to said projecting position, after said sheets are allowed to move past the intermediate portion of the sheet table, causing the top sheet of the stacked sheets to intermittently contact the feeding means; and conveying means for conveying the sheets one by one when they are brought into contact therewith after having been fed by said feeding means.

2. A sheet feeding apparatus according to claim 1, wherein the oblique sheet table is provided, at the lower end portion thereof, with a first guide plate formed substantially flat and extending toward the conveying means, and when the sheets stopped halfway to the sheet table slide down on the sheet table by releasing the member, the leading edges of these sheets are successively shifted from the top of them by the fixed guide plate.

3. A sheet feeding apparatus according to claim 2, wherein the fixed guide plate has a frictional member adjacent to the oblique sheet table to prevent overmovement of the lower sheets when the sheets stacked on the sheet table slide down on the sheet table.

4. A sheet feeding apparatus according to claim 3, wherein the fixed guide plate has sliding members adjacent to the conveying means, and the sliding members has a low frictional coefficient so that the upper sheets can slide nearer to the conveying means when the sheets stacked on the sheet table slide down on the sheet table.

5. A sheet feeding apparatus according to claim 2, wherein the sheet table is provided with a second guide plate arranged above the sheet table so as to smoothly guide the top sheet when the stacked sheets slide down on the sheet table.

6. A sheet feeding apparatus according to claim 2, wherein the conveying means is provided with upper and lower separating rollers, said upper separating rollers contacting one face of the sheet guided from the first guide plate and rotating in the direction in which the sheet is fed, while said lower separating rollers contacts the other face of the sheets, said lower separating rollers being rotatable in both directions in which the sheet is fed and returned, thereby enabling them to be separated one by one even if a plurality of sheets should be pulled in between the upper and the lower separating rollers.

7. A sheet feeding apparatus according to claim 6, wherein said upper and lower separating rollers face one another so that the lower separating rollers are in contact with those portions of the other side of the sheet which correspond to the contact portions of the one side of the sheet touched by the upper separating rollers when the sheet is held between the upper and the lower separating rollers.

8. A sheet feeding apparatus according to claim 7, wherein the conveying means includes a torque transmission mechanism transmitting rotation force to the separating rollers to return the sheet as the upper separating rollers rotate in the direction to pick up the sheet.

9. A sheet feeding apparatus according to claim 8, wherein said torque transmission mechanism incudes a rotation mechanism for transmitting rotation force to the lower separating rollers so that the lower separating rollers are rotated at a peripheral speed about three times that of the upper separating rollers.

10. A sheet feeding apparatus according to claim 9, wherein said upper and lower separating rollers each have frictional members thereon, whereby, when the sheet is held between the upper and the lower separating rollers, rotation force is transmitted from the surfaces of the upper separating rollers to the lower separating rollers to rotate the lower separating rollers in the direction to deliver the sheet if the friction force applied to the frictional members is greater than the rotation force transmitted by the torque transmission mechanism, and whereby the rotation force from the torque transmission mechanism is transmitted to the lower separating rollers to rotate the lower separating rollers in the direction to return the sheet if the friction force on the frictional members is smaller than the rotation force transmitted by the torque transmission mechanism.

11. A sheet feeding apparatus according to claim 10, wherein the frictional members on the surfaces of said upper separating rollers are formed of natural rubber, and the frictional members on the surfaces of said lower separating rollers are formed of urethane rubber.

12. A sheet feeding apparatus according to claim 10, wherein said torque transmission mechanism includes a first roller shaft coupled to the lower separating rollers, a second roller shaft for rotating the lower separating rollers to return the sheets, and a coil spring having one end fixed to the second roller shaft and the other end connected to the second roller shaft so as to be able to slide thereon under a given friction force, whereby the rotation force of the second roller shaft is transmitted through the coil spring to the first roller shaft by the given frictions force, and the lower separating rollers are subjected to a rotation force for returning the sheet.

13. A sheet feeding apparatus according to claim 6, wherein the feeding means is provided with conveying rollers for further conveying the sheets which have been separated one by one by the upper and lower separating rollers.

14. A sheet feeding apparatus according to claim 13, wherein third guide members are provided between the upper and lower separating rollers and the conveying rollers to enable the sheets to be smoothly conveyed.

15. A sheet feeding apparatus according to claim 14, wherein each of the third guide members is formed to have a reversed V-shaped projection and has one end left free, whereby these projections can be made substantially flat when pressing force is applied thereto and whereby the sheet conveyed can be waved by the projections of the third guide members.

* * * * *